US005248234A

United States Patent [19]

Hollenstein

[11] Patent Number: 5,248,234

[45] Date of Patent: Sep. 28, 1993

[54] BOOKBINDING METHOD AND APPARATUS

[75] Inventor: Hans Hollenstein, Guntershausen, Switzerland

[73] Assignee: GRAPHA-Holding AG, Hergiswil, Switzerland

[21] Appl. No.: 939,074

[22] Filed: Sep. 1, 1992

[30] Foreign Application Priority Data

Sep. 3, 1991 [CH] Switzerland ..... 2581/91

[51] Int. Cl.[5] ..... B42B 2/02

[52] U.S. Cl. ..... 412/1; 412/35; 112/21

[58] Field of Search ..... 412/1, 35; 112/21

[56] References Cited

U.S. PATENT DOCUMENTS 3,782,306 1/1974 Bosshard .

FOREIGN PATENT DOCUMENTS 0295220 12/1988 European Pat. Off. .
524471 6/1972 Switzerland .

OTHER PUBLICATIONS

"Buchbindereimaschinen", B. M. Mordowin, pp. 250–266.

*Primary Examiner*—Mark Rosenbaum
*Assistant Examiner*—Kenneth J. Hansen
*Attorney, Agent, or Firm*—Peter K. Kontler

[57] ABSTRACT

Stacks consisting of selected numbers of neighboring signatures are bound together by at least two rows of stitches. The thread which is used to form the rows of stitches is severed subsequent to completed assembly of a stack and following partial assembly of the next-following stack. It is preferred to assemble at least two signatures of the next-following stack prior to severing of the thread between the finished stack and the growing stack.

15 Claims, 2 Drawing Sheets

BOOKBINDING METHOD AND APPARATUS

BACKGROUND OF THE INVENTION

The invention relates to improvements in bookbinding methods and apparatus. More particularly the invention relates to improvements in methods of and in apparatus for assembling predetermined numbers of signatures into books, magazines, pamphlets and like printed products wherein the signatures are held together by several rows of stitches.

European patent application Ser. No. 0 295 220 of Meratti et. al. (published Dec. 14, 1988) discloses a bookbinding method according to which the signatures of a stack are connected to each other by two rows of stitches including a row of plain stitches and a row of looped stitches. A blade is employed to sever the thread at the row of plain stitches while the thread is under tension due to forward movement of the stacks along their path. Such severing operation is preceded by extraction of thread from the interior of the signature through that hole in the fold which is adjacent the row of looped stitches and by cutting of the extracted thread. When the severing operation is completed, the stack of signatures is free to breathe (i.e., to expand) which causes a loosening of the rows of stitches. Furthermore the method of Meratti et. al. produces relatively long tails constituted by portions of thread at the severing locations; such elongated thread portions can interfere with further processing of the stacks of signatures.

Another drawback of the method of Meratti et. al. is that the signatures are likely to be damaged in the regions around the holes in their folds. This is due to extraction of thread from the signatures while the signatures are maintained in tightly compacted condition. Furthermore, it is rather difficult to properly and reliably engage the thread because such thread forms a relatively small loop.

OBJECTS OF THE INVENTION

An object of the invention is to provide a method which constitutes an improvement over and a further development of the method of Meratti et. al.

Another object of the invention is to provide a method which renders it possible to treat the signatures and the stacks of signatures gently, and which can be resorted to for the making of books, pamphlets, brochures, magazines and like printed products containing large or small numbers of signatures.

A further object of the invention is to provide a method which can be practiced in connection with the making of two or more rows of identical or different stitches.

An additional object of the invention is to provide a method which ensures reliable tensioning of the thread prior as well as subsequent to separation of neighboring stacks of signatures from each other.

Still another object of the invention is to provide a novel and improved apparatus for the practice of the above outlined method.

A further object of the invention is to provide the apparatus with novel and improved means for clamping the loops of thread which connects the signatures of a stack to each other.

Another object of the invention is to provide the apparatus with novel and improved means for clamping the thread prior to severing.

SUMMARY OF THE INVENTION

One feature of the present invention resides in the provision of a method of binding stacks each of which contains a predetermined number of signatures including a first signature and a last signature. The improved method comprises the steps of gathering a series of successive stacks including introducing discrete signatures into a path wherein the introduced signatures and the stacks are advanced sideways in a predetermined direction past a binding station and the signatures in the path have neighboring folds, and traversing piercing the folds of successively introduced signatures at the binding station inwardly by at least two spaced apart needles one of which carries a thread through the opening of the fold and into the interior of the introduced signature and provides the signatures of successive stacks with a first row of stitches extending at least substantially in the predetermined direction. Another needle provides the signatures of successive stacks with a second row of stitches also extending at least substantially in the predetermined direction, and the method further comprises the steps of transporting the thread within (i.e., in the interior of) the introduced signature from the one needle to the other needle, and severing the thread of at least one of the rows of stitches at the last signature of each of the series of stacks subsequent to traversing of at least two signatures of the next-following stack of the series.

The method can further comprise the steps of extracting the needles from the fold of the signature at the binding station, guiding the thread at the first row of stitches, and clamping the thread at the second row of stitches prior to each severing step. The second row of stitches can comprise looped stitches and the first row of stitches can comprise plain stitches.

The method can also comprise the steps of extracting the one needle from the fold of the last signature of each stack while the last signature is located at the binding station, and looping the thread at the extracted one needle around a guide which extends in the predetermined direction. The looping step of such method can be carried out prior to advancement of the first signature of the next-following stack to the binding station.

The method can further comprise the step of clamping a looped stitch at the binding station so that the looped stitch is clamped in the course of the severing step.

Another feature of the invention resides in the provision of an apparatus or machine for binding stacks each of which consists of a predetermined number of signatures and wherein each stack includes at least two signatures, namely a first signature and a last signature. The apparatus comprises means for introducing signatures into a predetermined path to gather therein a series of successive stacks consisting of signatures having neighboring folds and for advancing the signatures along the path in a predetermined direction past a binding station, first and second movable needles at the binding station, and means for moving the needles relative to the path so that the needles traverse from the outside the fold of the signature at the binding station. The first needle entrains into the interior of the traversed signature a thread which forms a first row of stitches extending at least substantially in the predetermined direction and connecting the signatures in successive stacks to each other. The apparatus further comprises an oscillating shuttle or other suitable means for transporting the thread within the signature at the binding station from the first needle to the second needle so that the second needle can form a second row of stitches extending at least substantially in the predetermined direction and connecting the signatures in successive stacks to each other, a thread guide which is disposed at the binding station adjacent one of the needles and extends at least substantially in the predetermined direction, and a thread holder adjacent the other needle.

The thread holder can comprise or constitute a thread clamping device, and the guide preferably extends substantially transversely of a stack at the binding station between the first and last signatures of such stack.

The clamping device preferably comprises a first portion and a second portion which is movable relative to the first portion in and counter to the predetermined direction. The two portions of the clamping device comprise complementary thread clamping surfaces which are preferably substantially or exactly parallel to a loop of the adjacent row of stitches. Such apparatus further comprises means for cutting the thread at the other needle. The cutting means can include one portion of the clamping device. For example, the cutting means can comprise a movable knife which cooperates with a counterknife forming part of or constituting one portion of the clamping device. One portion of the clamping device can be slidably telescoped into the other portion. The movable portion of the clamping device can be provided with one or more means for directing a looped stitch of the adjacent row of looped stitches between the first and second portions. The directing means can comprise one or more suitably inclined surfaces or facets on the respective portion of the clamping device.

Still further, the apparatus preferably comprises means for severing the thread at the front end of the guide, and such severing means can comprise a pair of scissors.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawings.

DESCRIPTION OF PREFERRED EMBODIMENTS

Figure 1:
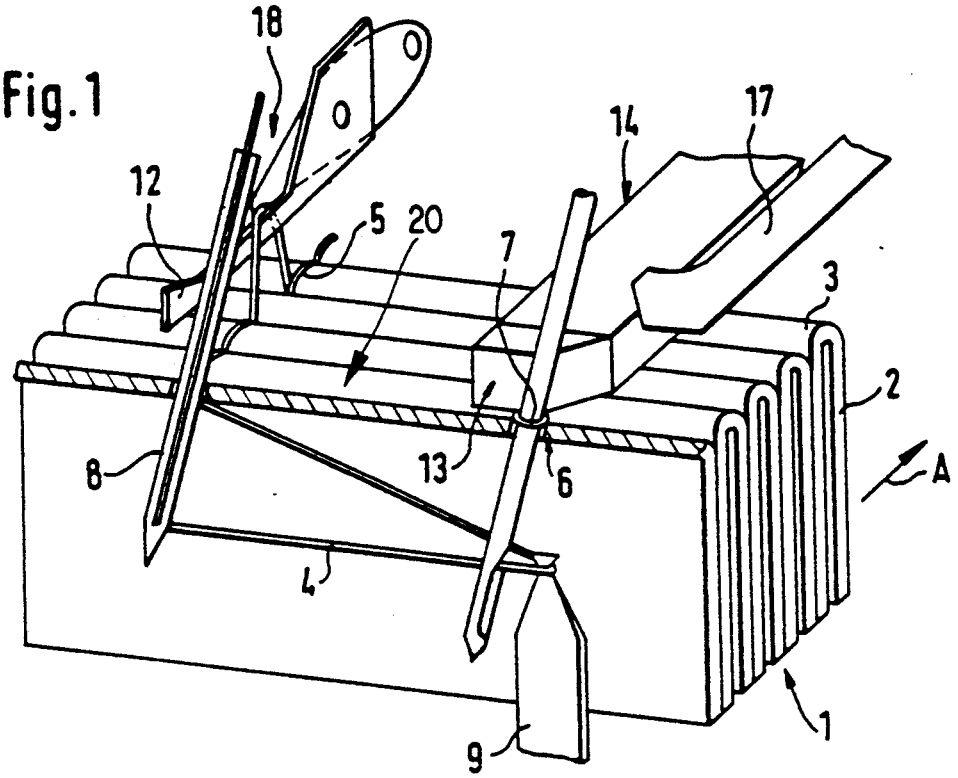
FIG. 1 is a schematic perspective view of a portion of an apparatus which embodies one form of the invention, the needles being shown in positions they assume upon traversal of the fold of a signature at the binding station.

FIG. 1 shows an apparatus forming part of a bookbinding machine and having means for connecting successive groups of four overlapping signatures 2 into a series of successive stacks 1 each having a first signature, a last signature and two intermediate signatures. The means for binding the signatures 2 to each other includes a thread 4 which is caused to form chain stitches, preferably so-called broche (plain) stitches and/or so-called superstitches. The basic design of such machines is well known and need not be described here. Reference may be had, for example, to U.S. Pat. No. 3,782,306 granted Jan. 1, 1974 to Bosshard for "Book binding method and machine therefor", to the corresponding Swiss Pat. No. 524 471 granted Jun. 30, 1992, and to the article by B. M. Mordowin on pages 250 et seq. of Volume 1 of "Buchbindereimaschinen" ("Book Binding Machines") published by VEB Verlag Technik Berlin. Such literature fully describes and illustrates numerous standard parts of book binding machines. These parts include a swingable saddle, one or more hole making needles, a needle plate and the means for moving such parts relative to each other. Furthermore, the above-enumerated literature fully describes means for introducing successive signatures into an elongated path for the signatures and assembled stacks as well as means for moving the signatures along the path in a predetermined direction so that successive signatures advance past a binding station.

Each of the four Figures shows a stack 1 of four neighboring signatures 2 which are introduced into the path for the stacks 1 and signatures 2 by a swingable saddle of known design. The arrow A indicates the direction of advancement of signatures 2 along their path past a binding station 20. The signatures 2 are advanced cyclically as the binding operation proceeds. There are two needles 8 and 10 which traverse the folds 3 of successive signatures 2 from the outside to form two rows of stitches including a first row 5 of plain stitches and a second row 6 of looped stitches 7. The two rows are parallel or nearly parallel with the direction (arrow A) of advancement of signatures 2 along their path. The points or tips of the needles 8 and 10 are caused to traverse the folds 3 of successive signatures 2 from above. The thread 4 is guided first to the needle 8 which forms the row 5 of plain stitches, and the same thread 4 is used to make the second row 6 of looped stitches 7. It is equally within the purview of the invention to provide more than two spaced apart rows of stitches.

Figure 2:
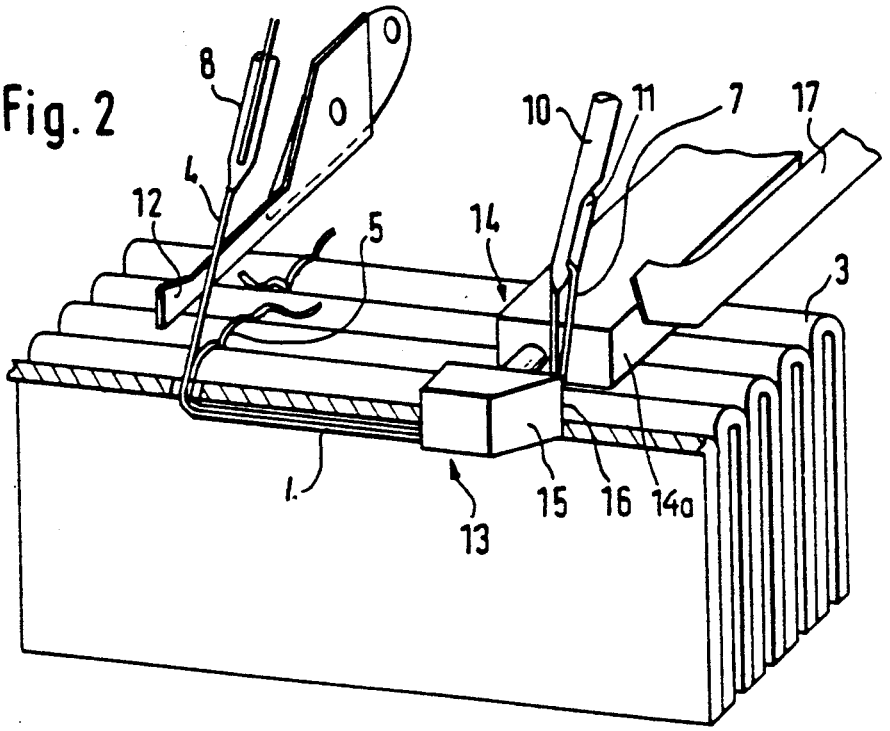
FIG. 2 illustrates the structure of FIG. 1 during another stage of binding the signatures of a stack by two rows of stitches.

The interior of the signature 2 at the binding station 20 surrounds an oscillatable shuttle 9 which serves to transport the thread 4 from the needle 8 to the needle 10 whereby the thread forms a loop 7 whenever it is transported in a signature 2 from the row 5 of plain stitches to the row 6 of looped stitches 7. As can be seen in FIGS. 1 and 2, the shuttle 9 transports two lengths of thread 4 and the thread within the signature 2 at the station 20 is engaged by a hooked portion 11 of the needle (crochet) 10. In FIG. 2, the needles 8, 10 are extracted from the signature 2 at the station 20 and the two lengths of thread 4 extend along the inner side of the fold 3 between the holes for the rows 5 and 6 of stitches. The thread 4 extends from the tip of the needle 8 to the hook 11 of the needle 10 and back toward and outwardly through the hole for the needle 8 to the adjacent stitch of the row 5. In FIG. 1, the needle 10 extends through the last loop 7 of the row 6 and is located in its inner end position (maximum penetration into the adjacent signature 2).

The stage of bookbinding operation which is shown in FIG. 1 is follows by the stage of FIG. 2. The first step involves extraction of the needles 8 and 10 from the interior of the adjacent signature 2. The thread 4 is under tension and two lengths of such thread extend along the inner side of the fold 3 between the holes which accommodated the extracted needles 8 and 10. The tip of the needle 8 is located at a level at least slightly above an elongated guide rail 12 which extends in the direction of arrow A and is adjacent the row 5 of plain stitches. The purpose of the guide rail 12 will be described in connection with FIGS. 3 and 4. The needle 10 has withdrawn the freshly formed loop 7 of the row 6 through the respective hole in the fold 3 of the adjacent signature 2, and a mobile portion 13 of a thread holder or thread clamping device 13 has been moved in front of the loop 7 (as seen in the direction of arrow A). The thread 4 is under tension and slides along a directing means or facet 15 of the mobile portion 13 to penetrate between the rear surface of the portion 13 and the front surface of the adjacent portion 14*a* of the clamping device 14. The facet 15 constitutes a suitably inclined surface on the mobile portion 13 of the clamping device 14 and the elasticity of the thread 4 suffices to ensure that such thread expands while sliding along the surface or facet 15 toward the clearance between the portions 13, 14*a* of the clamping device 14. The expanded thread 4 can contract when it advances beyond the edge 16 of the movable portion 13. FIG. 2 shows that the portion 13 has a shank which is slidably telescoped into the portion 14*a*, and FIG. 2 further shows that the freshly formed loop 7 is already located between the rear surface of the mobile portion 13 and the front surface of the other portion 14*a* of the clamping device 14.

The facet 15 can be replaced with a conical or frustoconical surface of the mobile portion 13. Alternatively, the portion 13 can be provided with two facets 15, one at each side of its shank.

Figure 3:
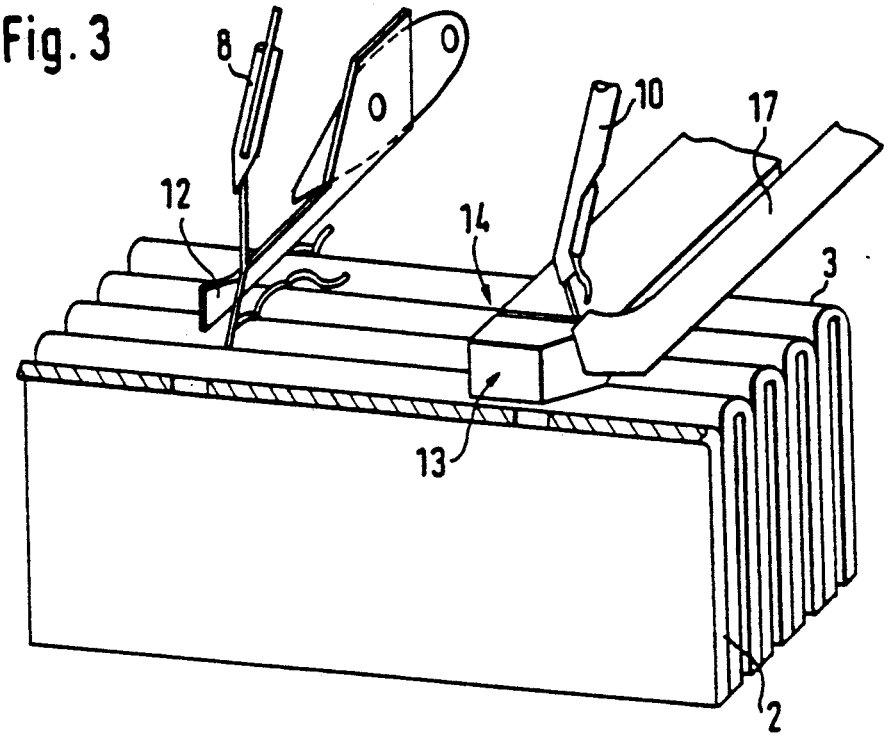
FIG. 3 illustrates the structure of FIG. 2 during a further stage of manipulation of signatures.
Figure 4:
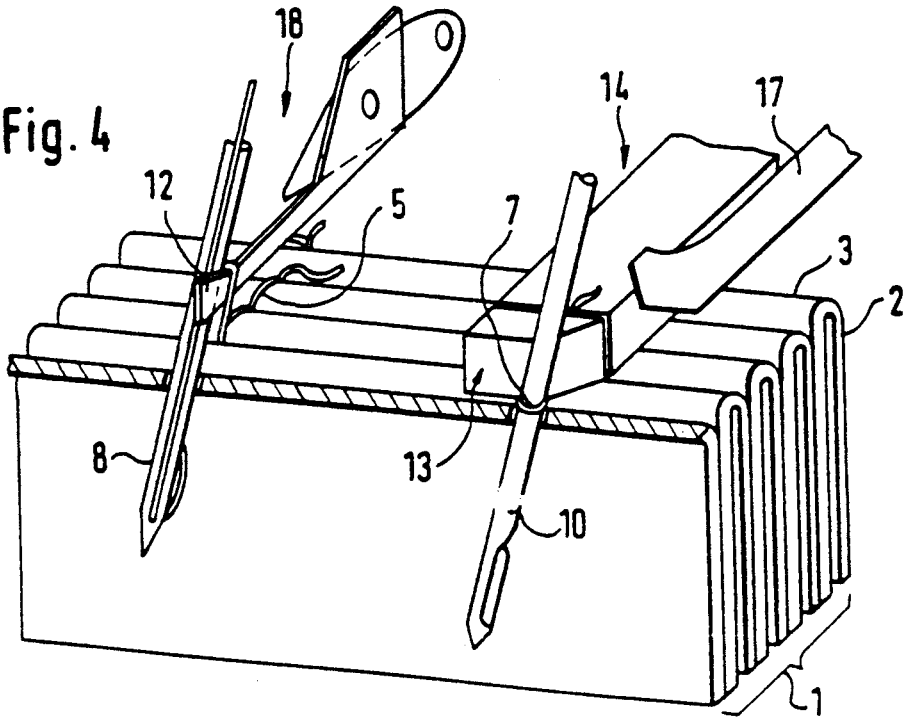
FIG. 4 is a similar view of the apparatus with the parts in positions they assume upon completed binding of four signatures into a complete stack.

The next stage of the bookbinding operation is shown in FIG. 3. The mobile portion 13 of the clamping device 14 has been withdrawn and cooperates with the portion 14*a* to clamp the last formed loop 7 of the row 6. A cutter including a knife 17 has severed the thread 4 at the row 6 of looped stitches 7, and a freshly introduced signature 2 is adjacent the last signature 2 of the preceding stack 1. The needle 8 and/or the guide rail 12 has been shifted sideways so that the thread 4 can be looped around the rail 12 prior to penetration of the needle 8 into the fold 3 of the next-following signature 2. The loop which is formed around the guide rail 12 is severed during the next-following cycles of the bookbinding machine (i.e., upon further advancement of the signatures 2 along their path) by a severing means here shown as scissors 18 (see FIG. 4). The needle 10 extends into the interior of the signature 2 at the binding station 20 and is in a position of readiness to receive thread 4 from the oscillatable shuttle 9. The thread 4 of the row 6 of stitches connecting the signatures 2 of the last complete stack 1 is still clamped by the device 14 while the assembly of signatures 2 to form the next stack 1 is already in progress. The knife 17 is shown in the retracted position.

The parts of the bookbinding machine reassume the positions of FIG. 1 not earlier than upon completion of an additional cycle, i.e., when the assembly of at least two signatures 2 to form the next stack 1 is already completed. The looped portion of the thread 4 which surrounds the guide rail 12 has reached the scissors 18 and is severed (FIG. 2) simultaneously with opening of the clamping device 14 to release the clamped loop 7 of the row 6.

An advantage of the improved method and apparatus is that the thread does not form an elongated tail at the last loop 7 of the row 6 of looped stitches of a finished stack 1. Furthermore, the thread is less likely to damage the material of the signatures 2 in the regions of the holes for the needles 8 and 10. The thread can be severed at a time when it is not under tension, and such severing takes place without risking a loosening of the stitches. The severing step is preferably delayed as long as possible, depending on the number of signatures 2 in a completed stack 1.

In accordance with a preferred embodiment, the rail 12 guides the single strand of thread 4 in substantial parallelism with the direction of advancement of signatures 2 upon completed extraction of needles 8 and 10 from the fold 3 of the last signature 2 of a stack 1 at least close to the starting positions of the needles, and the device 14 clamps the last loop 7 before the thread is severed. This renders it possible to carry out the stacking of signatures 2 in a highly predictable manner. The looping of thread 4 around the guide rail 12, which extends in substantial parallelism with the direction of advancement of signatures 2 along their path, also contributes to predictable assembly of signatures into stacks, e.g., into books, brochures, pamphlets or the like.

The guide rail 12 and the clamping device 14 enable the improved apparatus to overcome the drawbacks of the apparatus which is utilized for the practice of the method of Meratti et. al. The guide rail 12 preferably extends between the first and last signatures 2 of an assembled stack 1. The complementary surfaces of the portions 13, 14*a* of the clamping device 14 are preferably parallel or nearly parallel to the loop 7 at the binding station 20.

The provision in the bookbinding machine of a guide rail 12 and severing device 18 by itself constitutes a patentable innovation, i.e., a substantial improvement over heretofore known bookbinding and like machines. The same applies for the provision of the clamping device 14 and of the aforediscussed mode of operating this device to clamp a loop 7 prior to severing of the thread 4. The movable portion 13 of the clamping device 14 can constitute a counterknife which cooperates with the knife 17 to sever the thread 4. The cut can be made at right angles to and across the thread 4 immediately adjacent the clamping location.

When the device 14 is operative to clamp a , loop 7, the movable portion 13 is preferably located beneath the needle 10, i.e., the severed thread is clamped in order to avoid or to greatly reduce the extent of the aforediscussed "breathing" of expansion of a stack 1. The thread 4 slides along the surface 15 of the movable portion 13 while the latter is caused to advance counter to the direction of advancement of the stacks 1 (i.e., counter to the direction which is indicated by the arrow A), namely while the portion 13 moves relative to the portion 14*a* in the raised position of the needle 10. The stretching action of the surface 15 upon the thread 4 is sufficient to ensure that the expanded thread contracts between the complementary surfaces of the portions 13, 14*a* and is clamped by the device 14 in response to retraction of the shank of the portion 13 into the portion 14*a*. The thread 4 remains clamped during severing by the knife 17.

The portion 13 of the clamping device 14 can be reciprocated by a mechanical, electrical, pneumatic, hydraulic, magnetic or other suitable prime mover, not shown.

It is possible to replace the scissors 18 with other suitable severing means. Scissors are preferred at this time because they can sever the thread 4 without any or with a minimum of tensioning. Furthermore, the positions of the signatures 2 relative to each other can remain unchanged in the course of the severing step. The knife 17 can be replaced by scissors or by analogous cutting means. However, this is not absolutely necessary because the knife 17 severs the thread 4 adjacent the location of clamping the thread between the portions 13, 14*a* of the clamping device 14, i.e., stretching of the thread 4 during severing by the knife 17 does not tension and/or otherwise affect the loops 7 of the row 6 of looped stitches and/or the positions of the signatures 2 relative to each other.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of binding stacks each of which . contains a predetermined number of signatures including a first signature and a last signature, comprising the steps of gathering a series of successive stacks including introducing signatures into a path wherein the introduced signatures and the stacks are advanced sideways in a predetermined direction past a binding station and the signatures have neighboring folds; traversing the folds of successively introduced signatures at the binding station by at least two spaced apart needles one of which carries a thread through an opening of the fold and into the interior of the introduced signature and provides the signatures of successive stacks with a first row of stitches extending at least substantially in said direction, and the other of which provides the signatures of successive stacks with a second row of stitches extending at least substantially in said direction; transporting the thread within the introduced signature from the one needle to, the other needle; and severing the thread of at least one of the rows of stitches at the last signature of each of the series of stacks subsequent to transversing of the folds of at least two signatures of the next-following stack of said series.

2. The method of claim 1, further comprising the steps of extracting the needles from the fold of the signature at said binding station, guiding the thread at the first row of stitches, and clamping the thread at the second row of stitches so that the thread is clamped prior to each severing step.

3. The method of claim 2, wherein each second row of stitches comprises looped stitches.

4. The method of claim 1, further comprising the steps of extracting the one needle from the fold of the last signature of each stack while the last signature is located at said binding station, and looping the thread at the extracted one needle around a guide extending in said direction, said looping step being carried out prior to advancement of the first signature of the next-following stack to said binding station.

5. The method of claim 1, wherein said at least one row comprises looped stitches and further comprising the step of clamping a looped stitch at said station so that the looped stitch is clamped in the course of said severing step.

6. Apparatus for binding stacks each of which consists of a predetermined number of signatures including a first signature and a last signature, comprising means for introducing signatures into a predetermined path to gather a series of successive stacks consisting of signatures having neighboring folds and for advancing the signatures along said path in a predetermined direction past a binding station; first and second movable needles at said station; means for moving said needles relative to said path so that said needles transverse the fold of the signature at said station and said first needle entrains into the interior of the traversed signature a thread forming a first row of stitches extending at least substantially in said direction and connecting the signatures in successive stacks to each other; means for transporting the thread within the signature at said station from said first needle to said second needle so that said second needle forms a second row of stitches extending at least substantially in said direction and connecting the signatures in successive stacks to each other; a thread guide disposed at said station adjacent one of said needles and extending at least substantially in said direction; and a thread holder including a thread clamping device having a portion movable at said station in and counter to said predetermined direction.

7. The apparatus of claim 6, wherein said holder comprises a thread clamping device, said guide extending transversely between, the first and last signatures of a stack at said station.

8. The apparatus of claim 6, wherein said other needle includes means for forming a row of looped stitches, said device further comprising a second portion and said portions of said device having complementary thread clamping surfaces substantially parallel to a looped stitch of said row of looped stitches.

9. The apparatus of claim 6 wherein said guide has a front end and a rear end said severing means comprising means for severing the thread at the front end of said guide.

10. The apparatus of claim 9, wherein said means for severing the thread at the front end of said guide comprises scissors.

11. The apparatus of claim 6 wherein said severing means comprises means for cutting the thread at said holder, said cutting means comprising a knife.

12. Apparatus for binding stacks each of which consists of a predetermined number of signatures including a first signature and a last signature, comprising means for introducing signatures into a predetermined path to gather a series of successive stacks consisting of signatures having neighboring folds and for advancing the signatures along said path in a predetermined direction past a binding station; first and second movable needles at said station; means for moving said needles relative to said path so that said needles traverse the fold of the signature at said station and said first needle entrains into the interior of the traversed signature a thread forming a first row of stitches extending at leas substantially in said direction and connecting the signatures in successive stacks to each other; means for transporting the thread within the signature at said station from said first needle to said second needle so that said second needle forms a second row of stitches extending at least substantially in said direction and connecting the signatures in successive stacks to each other; a thread guide disposed at said station adjacent one of said needles and extending at least substantially in said direction; a thread holder adjacent the other of said needles, said thread holder including a thread clamping device having a first portion and a second portion movable relative to said first portion; and means for cutting the thread at said other needle, said cutting means including one portion of said clamping device.

13. Apparatus for binding stacks each of which consists of a predetermined number of signatures including a first signature and a last signature, comprising means for introducing signatures into a predetermined path to gather a series of successive stacks consisting of signatures having neighboring folds and for advancing the signatures along said path in a predetermined direction past a binding station; first and second movable needles at said station; means for moving said needles relative to said path so that said needles transverse the fold of the signature at said station and said first needle entrains into the interior of the traversed signature a thread forming a first row of stitches extending at least substantially in said direction and connecting the signatures in successive stacks to each other; means for transporting the thread within the signature at said station from said first needle to said second needle so that said second needle forms a second row of stitches extending at least substantially in said direction and connecting the signatures in successive stacks to each other; a thread guide disposed at said station adjacent one of said needles and extending at least substantially in said direction; and a thread holder adjacent the other of said needles, said thread holder comprising a thread clamping device including a first portion and a second portion which is slidably telescoped into said first portion.

14. Apparatus for binding stacks each of which consists of a predetermined number of signatures including a first signature and a last signature, comprising means for introducing signatures into a predetermined path to gather a series of successive stacks consisting of signatures having neighboring folds and for advancing the signatures along said path in a predetermined direction past a binding station; first and second movable needles at said station; means for moving said needles relative to said path so that said needles traverse the fold of the signature at said station and said first needle entrains into the interior of the traversed signature a thread forming a first row of stitches extending at least substantially in said direction and connecting the signatures in successive stacks to each other; means for transporting the thread within the signature at said station from said first needle to said second needle so that said second needle forms a second row of stitches extending at least substantially in said direction and connecting the signatures in successive stacks to each other; a thread guide disposed at said station adjacent one of said needles and extending at least substantially in said direction; and a thread holder adjacent the other of said needles, said other needle including means for forming a row of looped stitches and said thread holder comprising a first portion adjacent the row of looped stitches at said station and a second portion movable relative to said first portion in and counter to said direction, said second portion of said holder having means for directing a looped stitch of said row of looped stitches between said first and second portions.

15. The apparatus of claim 14, wherein said directing means includes at least one inclined surface on said second portion.

* * * * *